United States Patent [19]

Rosenthal et al.

[11] 4,440,516

[45] Apr. 3, 1984

[54] TRANSPORT DEVICE FOR TRANSPORTING AN ENDLESS FORM TO AND FROM THE PRINTING ROLLER

[75] Inventors: Manfred Rosenthal, Kirchen-Freusburg; Wendelin Weber, Siegen, both of Fed. Rep. of Germany

[73] Assignee: U.S. Philips Corporation, New York, N.Y.

[21] Appl. No.: 327,974

[22] Filed: Dec. 7, 1981

[30] Foreign Application Priority Data

Dec. 11, 1980 [DE] Fed. Rep. of Germany ..... 3046592

[51] Int. Cl.³ ..... B41J 11/32

[52] U.S. Cl. ..... 400/616.1; 400/616.2; 400/618; 226/170; 226/174

[58] Field of Search ..... 400/616.1, 616.2, 618, 400/648, 649, 261; 101/225; 226/170, 174

[56] References Cited

U.S. PATENT DOCUMENTS 2,140,028 12/1938 Nichols ..... 400/616.2

3,161,277 12/1964 Smithbauer ..... 400/616.1

FOREIGN PATENT DOCUMENTS 2436971 2/1976 Fed. Rep. of Germany ..... 226/174

*Primary Examiner*—Edgar S. Burr

*Assistant Examiner*—David A. Wiecking

*Attorney, Agent, or Firm*—David R. Treacy

[57] ABSTRACT

A detachable paper transport device for a printer having a printing roller, using two transport chains. The device has two side walls on each of which a control lever is pivoted for selecting the spacing between the transport chain and the roller, to compensate for differences in the thickness or number of layers of the paper. The device side walls each have a slotted hole for engaging one member on the printer, and each control lever has a bearing lug for engaging another member on the printer to slide the device along the slotted holes.

10 Claims, 3 Drawing Figures

TRANSPORT DEVICE FOR TRANSPORTING AN ENDLESS FORM TO AND FROM THE PRINTING ROLLER

BACKGROUND OF THE INVENTION

The invention relates to a transport device for transporting an endless form to and from the printing roller which is journalled in walls of the frame of the printing mechanism of an office machine, the transport device comprising transport chains which cooperate pairwise and which are arranged on at least one drive shaft which is journalled in sidewalls, and also comprising a drive which transmits the rotary movement of the printing roller to the drive shaft.

U.S. Pat. No. 3,161,277 discloses a device for permanently holding taut an endless form which is transported to and from a printing roller by a pair of transport chains. A shaft is arranged near the printing roller across the full width of the endless form in order to keep the endless form taut between the transport chains and the printing roller. In order to keep the form taut also in the deflected position of the printing roller, the shaft is journalled so that it can be lowered. Therefore, on the side of the frame of the printing mechanism there are provided sliding rails which are shifted by an eccentric. Moreover, the sliding rails comprise slits in which a pin of the mounting of the printing roller engages. The lifting and lowering of the shaft are thus frictionally coupled to the pivoting of the printing roller.

The known device has the drawback that the rigid coupling means that the distance between the transport chains and the printing roller always remains constant during operation, so that the inserted endless forms are subject to the same tension during transport only when they have the same thickness.

It is known, however, that different endless forms are inserted into office machines. For example, the paper thickness of the individual layers as well as the number of layers may be different. As a result, transport perforations of the endless form are liable to be damaged, notably when it consists of only one layer of paper. In the case of several layers, the endless form, moreover, is constantly subject to uncontrollable tensions due to manufacturing tolerances of the printing roller and the transport chains as well as tolerances in the distance therebetween.

SUMMARY OF THE INVENTION

It is an object of the invention to provide a transport device which can be simply adjusted to different endless forms as desired, without substantial additional means being required.

This object is achieved in that on each of the sidewalls there is pivotably journalled a control lever which comprises, on the one side of the pivot, a projection for locking in different pivoted positions; and on the other side, a bearing lug arranged to cooperate with a bolt or pin on each of the frame walls. Each of the side walls is provided with a slotted hole, each of which holes may engage a further bolt or pin provided on the frame walls, the sidewalls sliding along the slotted holes when the control lever is pivoted so that the distance between the transport chains and the printing roller can be changed.

Preferably, the longitudinal axis of the slotted holes is situated in the connecting plane of the two bolts. When, on the one hand, the bearing lugs are formed by two oppositely situated clamping noses and, on the other hand, the slotted hole is constructed to be open-ended, the complete transport device can be arranged on the printing mechanism as a removable unit. Both control levers on the sidewalls of the transport device may be individually journalled or may be rigidly interconnected by means of a shaft. In the former case each control lever must be separately moved, while in the latter case the pivoting of one of the two control levers suffices.

An embodiment of the invention will be described in detail hereinafter.

DESCRIPTION OF THE PREFERRED EMBODIMENT

Figure 1:
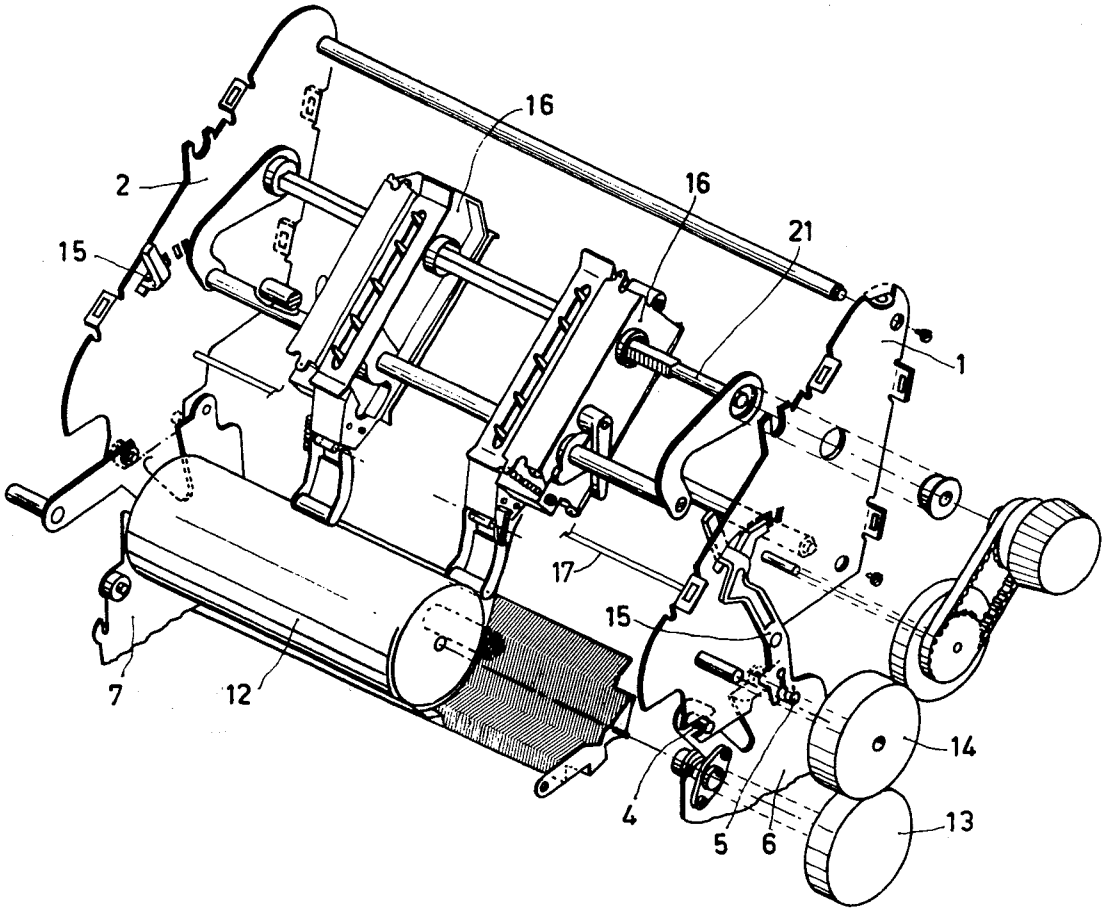
FIG. 1 is a perspective view of the transport device.

The transport device for endless forms is constructed as a detachable unit which can be simply mounted. In order to enable easy mounting on the printing mechanism, a clamping connection is used. Each of the sidewalls 1 and 2 comprises an open-ended slotted hole 3. The bolts or pins 4 and 5 for mounting the transport device on the printing mechanism are connected to the frame walls 6 and 7 which form part of the printing mechanism. To the left and the right of the printing roller 12, the casing 8 of the printing mechanism, only partly shown in the FIGS. 2 and 3, has an opening to enable the insertion of the sidewalls 1 and 2.

Figure 2:
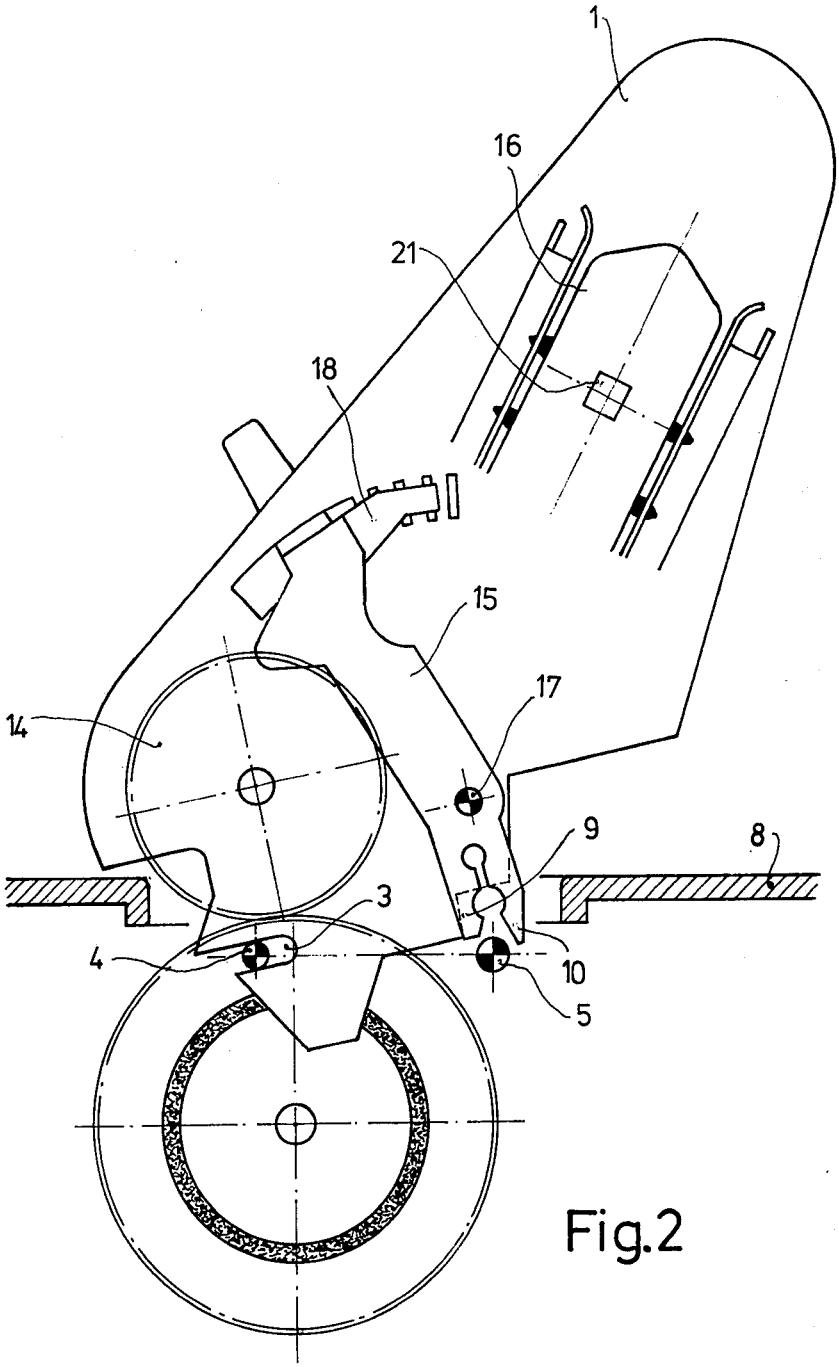
FIG. 2 is a side elevation of the transport device taken during the mounting on the printing mechanism.
Figure 3:
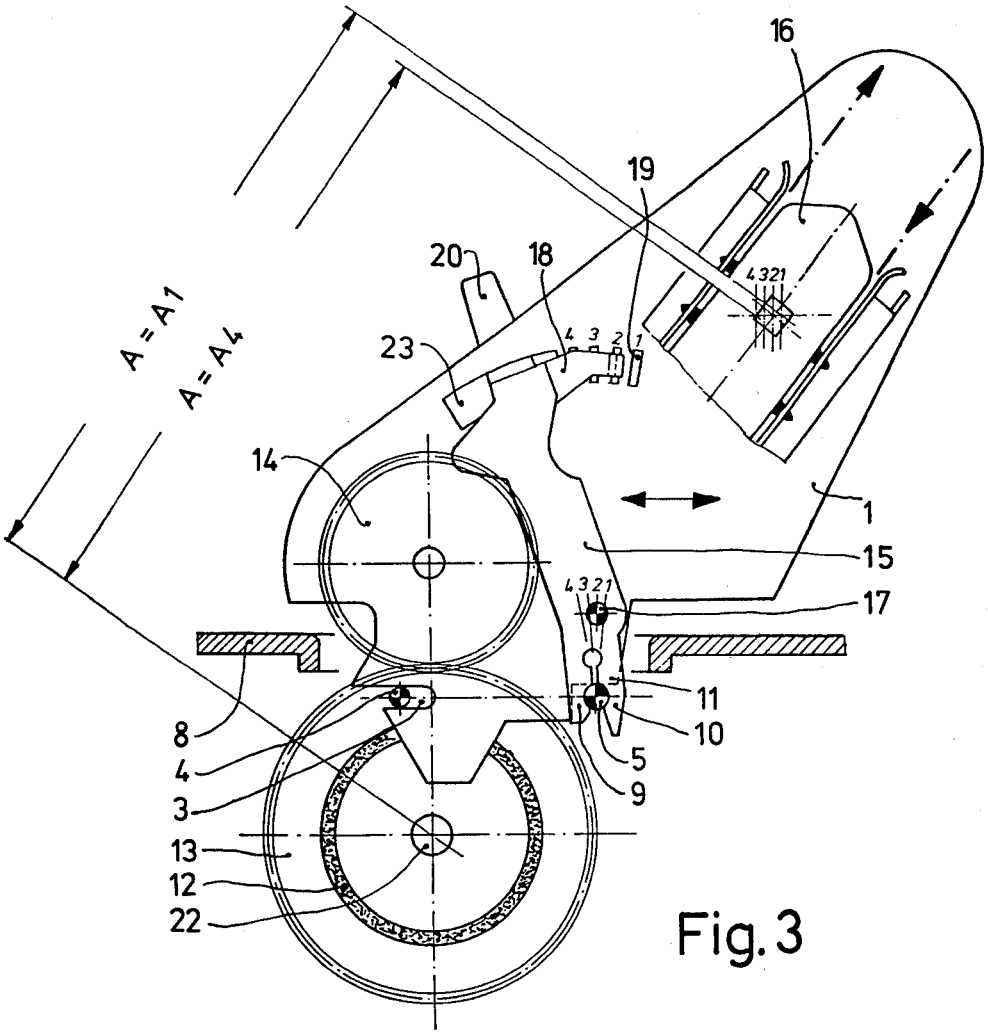
FIG. 3 is a side elevation of the mounted transport device.

FIG. 2 shows the mounting of the transport device. The slotted holes 3 are fitted on the bolts 4 by tilting the transport device forwards, the transport device being subsequently tilted backwards again until the clamping noses 9 and 10, together forming a bearing lug defining a bearing hole whose center is aligned with the slotted hole, engage behind the second bolts or pins 5. In order to prevent the two clamping noses 9 and 10 from being damaged by overloading, the sidewalls 1 and 2 each have an edge 11 which bears on the associated bolt 5 in the operative position of the transport device and which prevents further movement during mounting, thus relieving the bearing lug. After mounting, the teeth of the gear wheel 13 secured on the printing roller 12 and the gear wheel 14 of the transport device engage and form the drive for the transmission of forces from the printing roller 12 to the drive shaft 21 for the transport chains 16.

The detachable mounting of the transport device on the printing mechanism can also be realized in a different manner. It must be ensured merely that the transport device can be shifted on the printing mechanism by the control levers 15.

When an endless form is transported to the printing roller by means of the transport chains 16 and is removed therefrom behind the printing position, the distance A must be variable in accordance with the form thickness of the number of layers of the form. A particularly attractive solution is the fixed assignment of the distance A to the form thickness or the form layers. To this end, the distance between the transport chains 16, notably the drive shaft 21 thereof, and the printing roller 12, notably its bearing shaft 22, is adjustable. This function is served by the control lever 15 which at the same time permits the detachable mounting of the transport device on the printing mechanism.

The control lever 15 is secured to the sidewalls 1 and 2 of the transport device in a pivot bearing or shaft 17, the shaft extending between and interconnecting the two levers 15. At its upper end there is formed an arm 18 which acts as a fixing spring. This arm is locked in any one of four positions or latch points which are punched into the sidewalls 1 and 2 as elongated holes 19. The grip 20 which also forms part of the control lever 15 and which is bent twice so that it can be passed through an opening 23 in the sidewalls 1 and 2, adjusts the distance A, the number 1 indicating the maximum distance A1 for the adjustment for single or double forms and the number 4 the maximum distance A4 for adjustment for six-fold or eight-fold forms. During adjustment from latch point 1 to the latch point 4, the control lever 15 pivots about the bolt 5. As a result, the pivot bearing 17 is shifted to the left in the direction of the arrow, so that the sidewalls 1 and 2 also slide to the left in the slotted hole 3. As a result of this shift, the distance A is reduced to the minimum value A4. During the pivoting of the control lever 15 from the latch position 4 to the latch position 1, shifting is performed in the reverse direction (to the right) in the direction of the arrow.

The shifting of the transport device is possible only when the two gear wheels 13 and 14 are arranged so that the gear wheel 14 is approximately perpendicularly over the gear wheel 13 in the central position of the transport device, i.e. in the latch positions 2 and 3. Forward and backward shifting of the gear wheel 14 within a given range then only has a negligibly small influence on the gear meshing in the range of engagement, so that it is acceptable.

What is claimed is:

1. A transport device for transporting an endless form to and from a printing mechanism, which mechanism has a printing roller and a frame within which the roller is journalled for rotation about a roller axis, the frame having two pairs of members for mounting a transport device, the members of each pair being disposed at respective axial locations with respect to the printing roller axis and spaced from each other transversely with respect to said axis, said transport device comprising two side walls, at least one drive shaft journalled in the side walls, and transport chains which cooperate pair-wise and are arranged on said at least one drive shaft, characterized in that the device further comprises a respective control lever journalled to each of said side walls for pivoting about a lever axis, said lever comprising a bearing lug disposed to one side of the pivot axis, arranged for engaging one of said members on the mechanism frame, said device further comprising means for releasably locking the lever in a selected one of a plurality of pivotal positions, said means comprising a projection arranged on each lever at the other side of the pivoting axis for resiliently and releasably engaging the respective device side wall at a respective one of a plurality of positions, and each side wall of the device has a slotted hole for engaging the other member of the respective pair, arranged such that pivoting of the lever causes the side wall to slide along the slotted hole with respect to said other member to adjust the distance between the transport chains and the printing roller.

2. A device as claimed in claim 1, characterized by further comprising means for rigidly interconnecting said two control levers.

3. A device as claimed in claim 1 or 2, characterized in that said slotted holes are open at respective ends remote from the respective control levers, and said bearing lugs are arranged to detachably engage the respective one members on said frame.

4. A device as claimed in claim 3, characterized in that each of said lever bearing lugs consists of two clamping noses disposed opposite each other.

5. A device as claimed in claim 4, characterized in that said slotted holes are arranged with parallel longitudinal axes aligned with respect to the center of a bearing hole formed by the respective bearing lugs of the levers on the respective side walls.

6. A device as claimed in claim 5, characterized in that each control lever comprises a double-bent grip arranged to pass through an opening in the respective side wall.

7. A device as claimed in claim 1, characterized in that said slotted holes are arranged with parallel longitudinal axes aligned with respect to the center of a bearing hole formed by the respective bearing lugs of the levers on the respective side walls.

8. A transport arrangement for transporting an endless form to and from a printing mechanism, which mechanism has a printing roller and a frame within which the roller is journalled for rotation about a roller axis, the frame having two pairs of members for mounting a transport device, the members of each pair being disposed at respective axial locations with respect to the printing roller axis and spaced from each other transversely with respect to said axis, said arrangement including a detachable transport device comprising two side walls, at least one drive shaft journalled in the side walls and transport chains which cooperate pair-wise and are arranged on said at least one drive shaft, characterized in that each of said members is a pin, the members of one pair being parallel to each other and aligned with respective members of the other pair, the device further comprises a respective control lever journalled to each of said two side walls for pivoting about a lever axis, each said lever comprising a bearing lug disposed to one side of the pivot axis, arranged for releasably engaging one of said members on the mechanism frame; and means for releasably locking the lever in a selected one of a plurality of pivotal positions, said means comprising a projection arranged on each lever at the other side of the pivoting axis for resiliently and releasably engaging the respective device side wall at a respective one of a plurality of positions, and each side wall of the device has an open-ended slotted hole for engaging the other member of the respective pair, said slotted holes being arranged with parallel longitudinal axes aligned with respect to the respective bearing lugs of the levers on the respective side walls, such that pivoting of the lever causes the side wall to slide along the slotted hole with respect to said other member to adjust the distance between the transport chains and the printing roller.

9. An arrangement as claimed in claim 8, characterized by further comprising means for rigidly interconnecting said two control levers.

10. An arrangement as claimed in claim 9, characterized in that each of said lever bearing lugs consists of two resilient clamping noses disposed opposite each other.

* * * * *